US005232742A

United States Patent [19]

Chakravarti

[11] Patent Number: 5,232,742

[45] Date of Patent: Aug. 3, 1993

[54] SPIN FINISH COMPOSITION

[75] Inventor: Kalidas Chakravarti, Midlothian, Va.

[73] Assignee: Bridgestone/Firestone, Inc., Akron, Ohio

[21] Appl. No.: 883,737

[22] Filed: May 15, 1992

[51] Int. Cl.[5] ..... B05D 3/02

[52] U.S. Cl. ..... 427/387; 8/115.6; 252/8.6; 252/8.9; 427/393.1; 428/395

[58] Field of Search ..... 106/18.12, 287.16; 252/8.6, 8.9; 427/387, 393.4, 393.1; 8/115.6; 428/395

[56] References Cited

U.S. PATENT DOCUMENTS

| | | | |
|---|---|---|---|
| 3,620,823 | 11/1971 | Smith | 252/8.9 X |
| 3,850,658 | 11/1974 | Gomez et al. | 428/357 |
| 3,940,544 | 2/1976 | Marshall et al. | 428/378 |
| 3,993,571 | 11/1976 | Marshall | 252/8.9 |
| 4,098,702 | 7/1978 | Crossfield et al. | 252/8.6 |
| 4,103,068 | 7/1978 | Marshall et al. | 428/395 |
| 4,105,567 | 8/1978 | Koener et al. | 252/8.9 X |
| 4,105,568 | 8/1978 | Marshall et al. | 252/8.6 |
| 4,105,569 | 8/1978 | Marshall | 252/8.6 |
| 4,126,564 | 11/1978 | Marshall et al. | 252/8.75 |
| 4,129,507 | 12/1978 | Marshall et al. | 252/8.8 |
| 4,190,545 | 2/1980 | Marshall et al. | 252/8.9 |
| 4,191,656 | 3/1980 | Marshall | 252/8.6 |
| 4,192,754 | 3/1980 | Marshall et al. | 252/8.8 |
| 4,193,880 | 3/1980 | Marshall | 252/8.8 |
| 4,283,292 | 8/1981 | Marshall et al. | 252/8.8 |
| 4,293,460 | 10/1981 | Marshall et al. | 524/585 |
| 4,371,658 | 2/1983 | Marshall et al. | 524/585 |
| 4,552,671 | 11/1985 | Ogiso et al. | 252/8.9 |
| 4,561,987 | 12/1985 | Yamamoto et al. | 252/8.9 |
| 4,578,116 | 3/1986 | Rott et al. | 106/18.12 |
| 4,767,646 | 8/1988 | Cordova et al. | 437/387 |
| 4,915,855 | 4/1990 | Gillberg-LaForce et al. | 252/8.9 |
| 4,960,431 | 10/1990 | Cordova et al. | 8/115.6 |
| 4,995,884 | 2/1991 | Ross et al. | 8/115.6 |

OTHER PUBLICATIONS

IFJ, Oct. 1989, pp. 26, 28, 30, 32, 34, 37, 38, 40, 42.

*Primary Examiner*—Michael Lusigan

*Attorney, Agent, or Firm*—Daniel N. Hall

[57] ABSTRACT

Spin finish concentrate composition and the oil-in-water emulsion made from the concentrate for application for conventional speed or high speed melt spinning processes for producing polyester or polyamide yarns, consists essentially of oil lubricant component, pentaerythritol ester lubricant, ethoxylated sorbitan monooleate of HLB ranging from 6 to 15, anionic antistatic agent, water soluble sulfosuccinate wetting agent, and oil soluble ethoxylated polymethylsiloxane wetting agent having molecular weight of 400 to 700 and an aqueous surface tension value of less than 21 dynes/cm. The concentrate has long term stability. The finish prepared from the concentrate produces excellent quality yarn with virtually no broken filaments, and leaves no deposits on heated draw rolls, relaxation rolls and any yarn guides during spinning and drawing operations.

12 Claims, No Drawings

SPIN FINISH COMPOSITION

TECHNICAL FIELD

This invention is directed at a spin finish composition useful for high speed spinning of polyester and polyamide yarns as well as for conventional speed spinning of polyester and polyamide yarns.

BACKGROUND OF THE INVENTION

Conventional speed spinning involves take-up speeds of 3,000 meters per minute or less. Recently, consideration has been given to developing processes for high-speed spinning, that is involving take-up speeds of greater than 3,000 meters per minute, e.g. with yarn winding speeds of about 6,000 to 7,000 meters per minute for highly oriented, fully drawn polyester yarns (e.g. polyethylene terephthalate yarns) and of over 5,000 meters per minute for highly oriented, fully drawn polyamide yarns. Most conventional spin finishes have been found not to be suitable for the high speed spinning processes being developed simply because the higher speeds do not provide sufficient time for wetting of the filaments being treated resulting in deficient finish pickup on yarn and hence poor frictional characteristics during yarn processing which often results in broken filaments. Furthermore, the higher roll temperatures required for preparing low shrinkage polyester yarn with said high speed spinning processes cause conventional spin finishes to deposit on processing machinery (e.g., draw and relaxation rolls) necessitating frequent cleaning.

SUMMARY OF THE INVENTION

It is an object of the invention herein to overcome the aforestated deficiencies of conventional spin finishes for use with high speed spinning of polyester and polyamide yarns.

The invention herein is directed to a spin finish concentrate composition, which upon dilution with water or other low viscosity diluent to provide an oil-in-water emulsion or a low viscosity non-aqueous finish for use in high speed spinning of polyester or polyamide yarns to achieve the aforestated object. The oil-in-water emulsion also provides an excellent spin finish for application during high speed as well as conventional speed spinning of polyester and polyamide yarns.

The spin finish concentrate composition herein consists essentially by weight of (a) from 5 to 20 parts of oil lubricant selected from the group consisting of mineral oils and vegetable oils, (b) from 25 to 50 parts of pentaerythritol ester lubricant, (c) from 25 to 50 parts by weight of ethoxylated sorbitan monooleate emulsifying agent having an HLB (i.e. hydrophilic lipophilic balance) ranging from 6 to 15, (d) from 5 to 20 parts of anionic antistatic agent comprising oleyl phosphate ethoxylated with from 5 to 18 moles ethylene oxide, per mole of base material and neutralized, (e.g. sodium or potassium salt), (e) from 0.5 to 5 parts of water soluble sulfosuccinate wetting agent, (f) from 2 to 10 parts of soluble ethoxylated polymethylsiloxane wetting agent having a molecular weight ranging from 400 to 700, the total of (a), (b), (c), (d), (e) and (f) amounting to 100 parts.

This spin finish concentrate composition contains less than 10% by weight water which usually comes from certain of the ingredients used to prepare the composition, which are available commercially as water containing formulations.

The above concentrate composition is used to prepare an oil-in-water emulsion spin finish composition containing 10% to about 25% by weight of the concentrate composition in water, for application as a spin finish in the high speed spinning as well as in the conventional speed spinning of polyester and polyamide yarns.

This oil-in-water emulsion composition consists essentially weight of (a) from 0.5% to 5% oil lubricant selected from the group consisting of mineral oils and vegetable oils, (b) from 2.5% to 12.5% pentaerythritol ester lubricant, (c) from 2.5% to 12.5% ethoxylated sorbitan monooleate emulsifying agent having an HLB (hydrophilic lipophilic balance) ranging from 6 to 15, (d) from 0.5% to 4.0% anionic antistatic agent comprising oleyl phosphate ethoxylated with from 6 to 18 moles ethylene oxide per mole of base material and neutralized (e.g. sodium or potassium salt), (e) from 0.1% to 1.5% water soluble sulfosuccinate wetting agent, (f) from 0.1% to 1% oil soluble polymethylsiloxane wetting agent having a molecular weight ranging from 400 to 700, (g) from 75% to 90% water, and (h) an antibacterial effective amount of antibacterial agent.

Unless otherwise stated, all parts and percentages herein are by weight.

DETAILED DESCRIPTION

We turn now in more detail to the spin finish concentrate composition.

It preferably has a viscosity ranging from 30 to 100 centipoise at 25° C., more preferably from 40 to 60 centipoise at 25° C., as measured by a Brookfield viscometer.

The oil lubricant component of (a) is preferably a mineral oil having a viscosity of 40 to 150 SUS at 100° F. (about 6 to 30 centistokes at 40° C.), more preferably a viscosity of 50 to 70 SUS at 100° F.; a very suitable mineral oil of this type is sold under the name Klearol by Witco Chemical Company. Suitable vegetable oils have viscosities of, for example, about 6 to 40 centistokes at 40° C. and include, for example, coconut oil, cottonseed oil, palm kernel oil, and palm oil. Preferably the oil lubricant component is used in the spin finish concentrate composition in an amount of 7 to 15 parts per 100 parts of the total of (a), (b), (c), (d), (e) (f).

The pentaerythritol ester component of (b) preferably has four ester groups with 6 to 12 carbon atoms in each ester group, more preferably from 8 to 10 carbon atoms in an ester group. A very preferred pentaerythritol caprate/caprylate which contains four ester groups is sold under the name Lexolube 4N-415 by Inolex. An alternative is pentaerythritol tetrapelargonate which contains 9 carbon atoms in each ester group. Preferably the pentaerythritol ester component is used in the spin finish concentrate composition in an amount ranging from 35 to 45 parts per 100 parts of the total of (a), (b), (c), (d), and (f). This ingredient serves as a heat stable lubricant in the composition.

The ethoxylated sorbitan monooleate emulsifying agent component of (c) preferably has an average HLB (hydrophilic lipophilic balance) of 11–14. Preferably, two ethoxylated sorbitan monooleate ingredients are used in combination for the ethoxylated sorbitan monoolate emulsifying agent component to enable adjustment of the HLB to provide a stable oil-in-water emulsion for the ultimate finish composition. In a very preferred composition this emulsifying agent is provided by utilizing a combination of sorbitan monooleate ethoxylated with 5 moles of ethylene oxide per mole of base material (HLB of about 10) used in the spin finish concentrate composition in an amount of 10 to 25 parts, more preferably of 12 to 20 parts, per 100 parts of the total of (a), (b), (c), (d), (e) and (f), and sorbitan monooleate ethoxylated with 20 moles of ethylene oxide per mole of base material (HLB of about 15) used in the spin finish concentrate composition in an amount of 15 to 40 parts, more preferably from 16 to 20 parts, per 100 parts of the total of (a), (b), (c), (d), (e), and (f). A very suitable sorbitan monooleate ethoxylated with 5 moles of ethylene oxide per mole of base material is available under the name EMSORB 6901 from Henkel Corporation. A very suitable sorbitan monooleate ethoxylated with 20 moles of ethylene oxide per mole of base material is available under the name Tween-80 from ICI America, Inc. Besides functioning as an emulsifying agent, the ethoxylated sorbitan emulsifying agent component is important in providing bundle cohesiveness of fiber filaments.

The anionic antistatic agent component of (d) preferably comprises oleyl phosphate ethoxylated with 6 to 8 moles of ethylene oxide per mole of base material (neutralized). In a very preferred spin finish concentrate composition the anionic antistatic agent composition is provided by utilizing a combination of oleyl phosphate ethoxylated with 6 to 8 moles of ethylene oxide per mole of base material (neutralized) in an amount of 4 to 15 parts, more preferably in an amount of 6 to 10 parts, per 100 parts of the total of (a), (b), (c), (d), (e) and (f) and sodium petroleum sulfonate in an amount of 1 to 5 parts, more preferably in an amount of 1.5 to 3 parts, per 100 parts of the total of (a), (b), (c), (d), (e) and (f). A very suitable ethoxylated oleyl phosphate component is oleyl phosphate ethoxylated with 7 moles of ethylene oxide per mole of base material (neutralized) which is sold under the name Protolube 5865 by National Starch & Chemical Corp. A very suitable sodium petroleum sulfonate is sold under the name PETROSUL-742 by Penreco.

The water soluble sulfosuccinate wetting agent of (e) is preferably dinonyl sulfosuccinate salt (e.g. the sodium salt) and is preferably used in the spin finish concentrate composition in an amount of 0.75 to 3 parts per 100 parts of the total of (a), (b), (c), (d), (e) and (f). A very suitable product is sold under the name Nekal WS-25 by GAF Corp. Chemical Products; this product contains by weight 48% of the sulfosuccinate, 6% isopropanol and 46% water. This particular wetting agent provides residual wetting properties to treated yarn, i.e., it functions as a re-wetting agent.

The oil soluble ethoxylated polymethylsiloxane wetting agent of (f) preferably has a molecular weight ranging from 550 to 650 and is preferably used in an amount ranging from 3 to 7 parts per 100 parts of the total of (a), (b), (c), (d), (e) and (f). A preferred oil soluble ethoxylated polymethylsiloxane wetting agent has the formula $$Me_3SiO(Me_2SiO)_x(\underset{\underset{PE}{|}}{MeSiO})_ySiMe_3$$

where Me is Methyl and PE is $-CH_2CH_2CH_2O(EO)_mZ$ in which EO is ethylene oxide and Z is either hydrogen or a lower alkyl radical. An oil soluble ethoxylated polysiloxane wetting agent having this formula which has a molecular weight of about 600 is sold under the name Silwet L-77 by Union Carbide. Silwet L-77 is indicated to have a specific gravity of 1.007 (at 25/25° C.), an average weight per gallon at 25° C. of 8.37 lb, a coefficient of expansion at 25° C., per °C., of 0.00080, a viscosity at 25° C. of 20 centistokes, an aqueous surface tension at 25° C. on 0.1% (w/w) aqueous solutions using either the DuNouy Ring or Wilhelmy Plate Method, of 20.5 dyne/cm and an estimated HLB (hydrophilic lipophilic balance) of 5–8. This wetting agent promotes quick wetting of the finish components into the yarn. Water-dispersable alkoxylated polymethylsiloxanes with molecular weights greater than 1000 have been found to cause foaming resulting in nonuniformity, inferior wetting properties and poor emulsion stability. High molecular weight oil-soluble ethoxylated polymethylsiloxanes (molecular weight greater than 2000) showed inferior wetting properties.

The spin finish concentrate composition herein preferably is pourable at ambient temperature and contains less than 5% by weight water. The presence of water in the concentrate usually comes from ingredients used to prepare the concentrate such as Nekal WS-25, Protolube 5865, EMSORB 6901 and Tween-80. The presence of large amounts of water in the concentrate should be avoided for efficient storage of the concentrate composition and for better emulsion preparation.

We turn now to the preparation of the concentrate. As will be evident to those skilled in the art, the order of admixture will depend on the particular ingredients and will easily be determined without undue experimentation. For the preferred composition herein, the sodium petroleum sulfonate component and the ethoxylated sorbitan monooleate emulsifying agent component having 20 moles of ethylene oxide per mole of base material are preferably initially admixed and the resulting solution is next mixed with the lubricant components such as pentaerythyitol ester component and mineral oil component. Except for the above, there is no preference for the order of addition in preparing the preferred concentrate composition herein. The components are suitably admixed at ambient temperature, i.e., without heating or cooling. Preferably the components are added one by one with agitation. Once all the components are added, mixing for 15 minutes to 1 hour with a good shear rate provides a uniform and clear concentrate. The tank for preparation of the concentrate should not be contaminated with water, and it should be free of dust. The concentrate herein is physically and chemically stable from up to six months or more.

We turn now to the emulsion preparation. A calculated amount of deionized or distilled water is introduced into a tank different from the one in which the concentrate was made up. Warm deionized water, e.g. at 30° C., is most suitable. Agitation is started, and the calculated amount of the finish concentrate is added slowly near the shaft of the agitator with continued agitation until a stable emulsion is formed. With the preferred composition, this stable emulsion has a milky color with a bluish tinge.

After the oil-in-water emulsion is prepared, antifoaming agent in an antifoaming effective amount is preferably admixed (e.g. in an amount of 100 to 500 ppm) and antibacterial agent in an antibacterial effective amount is preferably admixed (e.g. in an amount of 200 to 500 ppm). The antifoaming agent provides uniform application of the emulsion on the yarn while the antibacterial agent prevents bacterial growth in the emulsion which usually causes problems in process performance and poor yarn quality. A variety of non-silicone type antifoaming agents were found to be suitable for this application. Suitable antibacterial agents include, sodium o-phenylphenate tetrahydrate (Dowicide A), 1-(3-chloroallyl)-3,5,7-triaza-1-azoniaadamantane chloride complex (Dowicil 75), and 6-acetoxy-2,4-dimethyl-1,3-dioxane sold under the name GIVGUARD DXN by the Givaudan Corp A preferred emulsion composition is an oil-in-water emulsion which consists by weight of (a) from 1.0% to 2.0% mineral oil, (b) from 4.1% to 8.2% pentaerythritol ester having four ester groups with 8 to 10 carbon atoms in each ester group, (c) from 1.5% to 3.0% sorbitan monooleate ethoxylated with 5 moles of ethylene oxide per mole of base material, (d) from 1.7% to 5.4% sorbitan monooleate ethoxylated with 20 moles of ethylene oxide per mole of base material, (e) from 0.8% to 1.6% of oleyl phosphate ethoxylated with 6 to 8 moles of ethylene oxide per mole of base material and neutralized, (f) from 0.2% to 0.4% of sodium petroleum sulfonate, (g) from 0.2% to 0.4% of dinonyl sulfosuccinate, sodium salt, (h) from 0.5% to 1.0% oil soluble ethoxylated polymethylsiloxane having a molecular weight ranging from 550 to 650, (i) from 80% to 90% water, (j) an antibacterial effective amount (e.g., 200 to 500 ppm) of antibacterial agent, and (k) an antifoaming effective amount of antifoaming agent.

The emulsion herein has a viscosity of less than 10 centipoise at 25° C. as determined with a Brookfield viscometer, and is physically and chemically stable up to a year or more. Moreover, it is environmentally safe in that it does not harm employees using it or consumers of the end products made with the yarns to which it is applied and finish wastes can be safely disposed of according to local government regulations.

Desired properties ar imparted when the emulsion is applied at a level of 0.35 to 1.3%, preferably 0.5% to 0.8%, by weight of the yarn. The emulsion should be applied after the melt spun fibers have reached their solidification state and prior to drawing. Preferably the emulsion is applied just after the point where the melt spun filaments reach their solidification state. The emulsion herein is readily applied using conventional application equipment, e.g. slot applicators or kiss rolls or combinations of these, in one or a plurality of passes.

Other diluents besides water, e.g. ethoxylated fatty alcohols such a decyl alcohol ethoxylated with 6 moles of ethylene oxide per mole of alcohol and lauryl alcohol ethoxylated with 4 moles of ethylene oxide per mole of alcohol and low molecular weight esters having a viscosity in the range of 20 to 30 centipoises at 25° C. as determined with a Brookfield viscometer, can be used with the concentrate herein for preparation of a suitable spin finish composition for applications where water is not desirable during fiber spinning.

Oil-in-water emulsion spin finish composition formed from the concentrate composition herein and the oil-in-water emulsion spin finish composition herein described above, provide a balancing of frictional properties whereby there is controlled yarn tension so that there is no slipping during yarn drawing and subsequent yarn processing and also so that filament breakage is minimized. The surface tension of the finished composition is low enough for fast and uniform penetration through the yarn bundle for improved spinning and drawing operations. Very importantly, there is no deposition or build up of resin-like residues from the spin finish on the processing equipment such as heated draw rolls or relaxation rolls and other guides so that the need for cleaning of the processing equipment is minimized. These advantages are obtained both when melt spinning is carried out at conventional speeds or at the high speed described above. The invention herein finds application, for example, in melt spinning, to produce polyester (e.g. polyethylene terephthalate) and polyamide yarns for reinforcing purposes, for example, in tires, hoses and conveyor belts.

The invention is illustrated by the following Example.

EXAMPLE

In a 15 gal. vessel, are thoroughly admixed 2.0 lbs. of Petrosul-742 (sodium petroleum sulfonate) and 17 lbs. of Tween-80 (sorbitan monooleate ethoxylated with 20 moles of ethylene oxide per mole of sorbitan monoleate) until a solution is formed. To this solution is added 10.0 lbs. of Klearol (mineral oil) with agitation. Then 41.0 lbs. of Lexolube 4-N-415 (pentaerythritol caprate/caprylate) is admixed with agitation. Then 8.0 lbs. of Protolube-5865 (oleyl phosphate ethoxylated with 7 moles of ethylene oxide per mole and neutralized) is admixed with agitation. Then 2.0 lbs. of Nekal WS-25 (composition including sodium salt of dinonyl sulfosuccinate described above) is admixed with agitation. Following this, 15.0 lbs. of Emsorb 6901 (sorbitan monooleate ethoxylated with 5 moles of ethylene oxide) is admixed with agitation. Finally 5.0 lbs. of Silwet L-77 (ethoxylated polymethylsiloxane having a molecular weight of 600) is admixed with agitation. The admixing of all of the components is carried out at ambient temperatures. Continuing of agitation of the formed composition is carried out for about 30 minutes at ambient temperature and at a good shear rate to provide a clear amber colored concentrate which is physically and chemically stable for at least three months. It contains by weight on a water-free, isopropanol-free basis, 10.1 % mineral oil, 41.2% pentaerythritol caprate/caprylate, 15.1% sorbitan monooleate ethoxylated with 5 moles of ethylene oxide per mole of sorbitan monooleate, 17.1% sorbitan monooleate ethoxylated with 20 moles of ethylene oxide per mole of sorbitan monooleate, 8.0% oleyl phosphate ethoxylated with 7 moles of ethylene oxide per mole of oleyl phosphate and neutralized, 2.0% sodium petroleum sulfonate, 1.5% dinonyl sulfosuccinate, sodium salt, and 5.0% ethoxylated polymethylsiloxane.

Into a different vessel of about 15 gallon capacity, 88 lbs of deionized water at 30° C., is introduced. Then agitation is started at moderate speed (600 RPM) and 12 lbs. of the concentrate is added slowly near the shaft of the agitator at a rate of 0.5 gallons per minute in proper amount so an oil-in-water emulsion containing about 88% water is obtained. The formed emulsion is milky colored with a bluish tinge. After the emulsion is formed, 10 grams of antifoaming agent and 200 grams of Givguard DXN antibacterial agent are added and stirring is continued for about 15 minutes. The resulting oil-in-water spin finish composition is physically and chemically stable and during application on melt spun polyester and polyamide yarns does not leave deposits on the processing machinery so that cleaning of processing machinery is minimized and provides excellent quality yarn products when high speed melt spinning as well as when conventional speed melt spinning processes are carried out.

Similar results to those described above are obtained when an equal amount of coconut oil replaces the mineral oil or when an equal amount of the ethoxylated oleyl phosphate replaces the sodium petroleum sulfonate or when other ethoxylate sorbitan monooleate ingredient or combination with a similar HLB replaces the exthoxylated sorbitan monooleate combination used.

Man variations of inventive embodiments will be obvious to those skilled in the art. Thus, the inventive embodiments are defined by the claims.

What is claimed is:

1. A spin finish concentrate composition for dilution for application to polyester yarn or polyamide yarn, said composition consisting essentially by weight of (a) from 5 to 20 parts of oil lubricant selected from the group consisting of mineral oils and vegetable oils, (b) from 25 to 50 parts of pentaerythritol ester lubricant, (c) from 25 to 50 parts of ethoxylated sorbitan monooleate emulsifying agent having an HLB ranging from 6 to 15, (d) from 5 to 20 parts of anionic antistatic agent comprising oleyl phosphate ethoxylated with from 5 to 18 moles of ethylene oxide per mole of base material and neutralized, (e) from 0.5 to 5 parts of water soluble sulfosuccinate wetting agent, (f) from 2 to 10 parts of oil soluble polymethylsiloxane wetting agent having a molecular weight ranging from 400 to 700 and containing side chain pendant to intermediate silicon atom, said side chain containing hydroxy or alkoxy terminated polyethoxy end moiety, the total of (a), (b), (c), (d), (e) and (f) amounted to 100 parts and said composition containing less than 10% water.

2. The spin finish concentrate composition of claim 1 wherein the oil lubricant of (a) is a mineral oil.

3. The spin finish concentrate composition of claim 2 wherein the pentaerythritol ester of (b) has four ester groups containing form 6 to 12 carbon atoms, wherein the ethoxylated sorbitan monooleate emulsifying agent of (c) has an average HLB ranging from 11 to 14, and wherein the water soluble sulfosuccinate wetting agent of (e) is dinonyl sulfosuccinate salt.

4. The spin finish concentrate composition of claim 3 which consists essentially by weight of from 10 to 25 parts of sorbitan monooleate ethoxylated with 5 moles of ethylene oxide per mole of base material and from 15 to 40 parts of sorbitan monooleate ethoxylated with 20 moles of ethylene oxide per mole of base material as (c), and from 4 to 15 parts of oleyl phosphate ethoxylated with 6 to 8 moles of ethylene oxide per mole of base material and neutralized and from 1 to 5 parts of sodium petroleum sulfonate as (d).

5. The spin finish concentrate composition of claim 4 wherein the pentaerythritol ester of (b) has four ester groups containing 8 to 10 carbon atoms and the ethoxylated polymethylsiloxane of (f) has a molecular weight ranging from 550 to 650.

6. The spin finish concentrate composition of claim 5 consisting essentially by weight of (a) from 7 to 15 parts of mineral oil, (b) from 35 to 45 parts of pentaerythritol ester having four ester groups containing from 8 to 10 carbon atoms, (c) from 12 to 20 parts of sorbitan monooleate ethoxylated with 5 moles of ethylene oxide per mole of base material and from 16 to 20 parts of sorbitan monooleate ethoxylated with 20 moles of ethylene oxide per mole of base material as the ethoxylated sorbitan monooleate emulsifying agent, (d) from 6 to 10 parts of oleyl phosphate ethoxylated with 6 to 8 moles of ethylene oxide per mole of base material and neutralized, and from 1.5 to 3 parts of sodium petroleum sulfonate as the anionic antistatic agent, (e) from 0.75 to 3 parts of dinonyl sulfosuccinate, sodium salt, and (f) from 3 to 7 parts of oil soluble ethoxylated polymethylsiloxane wetting agent having a molecular weight ranging from 550 to 650;

the total of (a), (b), (c), (d), (e) and (f) amounting to 100 parts, and said composition containing less that 5% water.

7. The spin finish concentrate composition of claim 1 wherein the polymethylsiloxane wetting agent (f) is the sole polymethylsiloxane in the composition.

8. The spin finish concentrate composition of claim 1 wherein the polyethoxy end moiety in side chain pendant to intermediate silicon atom in polymethylsiloxane wetting agent (f) is methoxy terminated.

9. The spin finish concentrate composition of claim 1 wherein said oleyl phosphate of (d) is ethoxylated with 6 to 8 moles of ethylene oxide per mole of base material and neutralized and containing at most 10 parts of said neutralized ethoxylated oleyl phosphate per 100 parts of (a), (b), (c), (d), (e) and (f).

10. A spin finish composition for application to polyester yarns or polyamide yarns, said composition being an oil-in-water emulsion and consisting essentially by weight of (a) from 0.5% to 5% oil lubricant selected from the group consisting of mineral oils and vegetable oils, (b) from 2.5% to 12.5% of pentaerythritol ester lubricant, (c) from 2.5% to 12.5% ethoxylated sorbitan monooleate emulsifying agent having an HLB ranging from 6 to 15, (d) from 0.5% to 4.0% of anionic antistatic agent comprising oleyl phosphate ethoxylated with from 5 to 18 moles of ethylene oxide per mole of base material and neutralized, (e) from 0.1% to 1.5% water soluble sulfosuccinate wetting agent, (f) from 0.1% to 1% oil soluble polymethylsiloxane wetting agent having a molecular weight ranging from 400 to 700 and containing side chain pendant to intermediate silicon atom, said side chain containing hydroxy or alkoxy terminated polyethoxy end moiety, (g) from 75 to 90% water, and (h) an antibacterial effective amount of anitbacterial agent.

11. A method of high speed spinning of polyester yarn comprising melt spinning polyester filaments, applying the spin finish composition of claim 10 thereto after the melt spun filaments have reached their solidification state, and then drawing the melt spun filaments with the spin finish composition thereon.

12. A spin finish composition for application to polyester or polyamide yarns, said composition being an oil-in water emulsion and consisting by weight of (a) from 1.0% to 2.0% mineral oil, (b) from 4.1% to 8.1% pentaerythritol ester having four ester groups containing from 8 to 10 carbon atoms, (c) from 1.5% to 3.0% sorbitan monooleate ethoxylated with 5 moles of ethylene oxide per mole of base material, (d) from 1.7% to 5.4% sorbitan monooleate ethoxylated with 20 moles of ethylene oxide per mole of base material, (e) from 0.8% to 1.6% of oleyl phosphate ethoxylated with 6 to 8 moles of ethylene oxide per mole of base material and neutralized, (f) from 0.2% to 0.4% of sodium petroleum sulfonate, (g) from 0.2% to 0.4% dinonyl sulfosuccinate, sodium salt, (h) from 0.5% to 1.0% oil soluble polymethylsiloxane having a molecular weight ranging from 550 to 650 and containing side chain pendant to intermediate silicon atom, said side chain containing hydroxy or alkoxy terminated polyethoxy end moiety, (i) from 80 to 90% water, (j) an antibacterial effective amount of antibacterial agent, and (k) an antifoaming effective amount of antifoaming agent.

* * * * *